US007973812B2

(12) United States Patent
Masuda

(10) Patent No.: US 7,973,812 B2
(45) Date of Patent: Jul. 5, 2011

(54) THERMAL PRINTER AND METHOD OF CONTROLLING THE SAME

(75) Inventor: Ken Masuda, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 61 days.

(21) Appl. No.: 12/553,185

(22) Filed: Sep. 3, 2009

(65) Prior Publication Data

US 2010/0060705 A1 Mar. 11, 2010

(30) Foreign Application Priority Data

Sep. 8, 2008 (JP) ..... 2008-230106

(51) Int. Cl.
*B41J 2/32* (2006.01)
*B41J 11/42* (2006.01)

(52) U.S. Cl. ..... 347/171; 347/220

(58) Field of Classification Search ..... 347/171, 347/220; 400/120.01, 648, 649
See application file for complete search history.

(56) References Cited

U.S. PATENT DOCUMENTS

2003/0112318 A1 * 6/2003 Long et al. ..... 347/171

FOREIGN PATENT DOCUMENTS

| | | | | |
|---|---|---|---|---|
| JP | 57-069071 | * | 4/1982 | ..... 400/82 |
| JP | 61-003765 | * | 1/1986 | ..... 400/82 |
| JP | 05-004369 | | 1/1993 | |
| JP | 2001-071569 | | 3/2001 | |

OTHER PUBLICATIONS

Machine-generated translation of JP 2001-071569, published on Mar. 21, 2001.*

* cited by examiner

*Primary Examiner* — Huan H Tran
(74) *Attorney, Agent, or Firm* — Turocy & Watson, LLP

(57) ABSTRACT

Movement of platen rollers are started at a predetermined timing considering the distance from a paper sensor to thermal heads, and a paper feeding speed, so that the movement of the platen rollers is completed at the time when the thermal paper reaches the thermal heads.

13 Claims, 9 Drawing Sheets

THERMAL PRINTER AND METHOD OF CONTROLLING THE SAME

CROSS-REFERENCE TO RELATED APPLICATION

This application is based upon and claims the benefit of priority from prior Japanese Patent Application No. 2008-230106, filed Sep. 8, 2008, the entire contents of which are incorporated herein by reference.

TECHNICAL FIELD

The present invention relates to a thermal printer using thermal paper having a thermosensitive on both sides, and a method of controlling the thermal printer.

BACKGROUND

There is a conventional thermal printer, which is provided with a thermal head at positions corresponding to one side and the other side of thermal paper having a thermosensitive layer on both sides, and prints both sides of thermal paper by operating both thermal heads, or prints one side of thermal paper by operating one of the thermal heads (e.g., Jpn. PAT. Appln. KOKAI Publication No. 2001-71569).

In the above thermal printer, when the front end of supplied thermal paper reaches a thermal head, feeding of thermal paper is stopped. In this state, a platen roller is moved to a thermal head, and thermal paper is inserted between the platen roller and thermal head. Feeding of thermal paper is restarted in this state, and a thermal head starts printing.

However, the printing speed is delayed by the time to stop feeding of thermal paper.

Further, a little "displacement" occurs between the position of thermal paper contacting a thermal head at stop of feeding thermal paper, and the print start position on thermal paper at the time of restarting the thermal paper feeding and starting printing. This "displacement" is caused by a play or error in movement of a driving system of each platen roller (e.g., a gear to transmit the power of a motor). This "displacement" causes a stripe-like line on thermal paper in a direction perpendicular to a paper feeding direction. This stripe-like line is called a white line, and greatly deteriorates the print quality.

SUMMARY

It is an object of the present invention to provide a thermal printer, which is configured to increase a printing speed, and prevent a stripe-like line on thermal paper, thereby improving the print quality.

A thermal printer according to an aspect this invention comprises: thermal paper, which has a thermosensitive layer on both sides, and is fed in a predetermined direction; a first thermal head which prints one side of the thermal paper; a second thermal head which prints the other side of the thermal paper; a first platen, which is provided at a position opposite to the first thermal head through a thermal paper feeding path, movable to or away from the first thermal head, and presses the thermal paper to the first thermal head by moving to the first thermal head; a second platen, which is provided at a position opposite to the second thermal head through the thermal paper feeding path, movable to or away from the second thermal head, and presses the thermal paper to the second thermal head by moving to the second thermal head; a first control section, which starts movement of the first platen at the time of printing with the first thermal head, so that the movement of the first platen is completed at the time when the thermal paper reaches the first thermal head; and a second control section, which starts movement of the second platen at the time of printing with the second thermal head, so that the movement of the second platen is completed at the time when the thermal paper reaches the second thermal head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the invention will be explained hereinafter with reference to the accompanying drawings. First, a configuration of an essential part is shown in FIG. 1.

Figure 1:
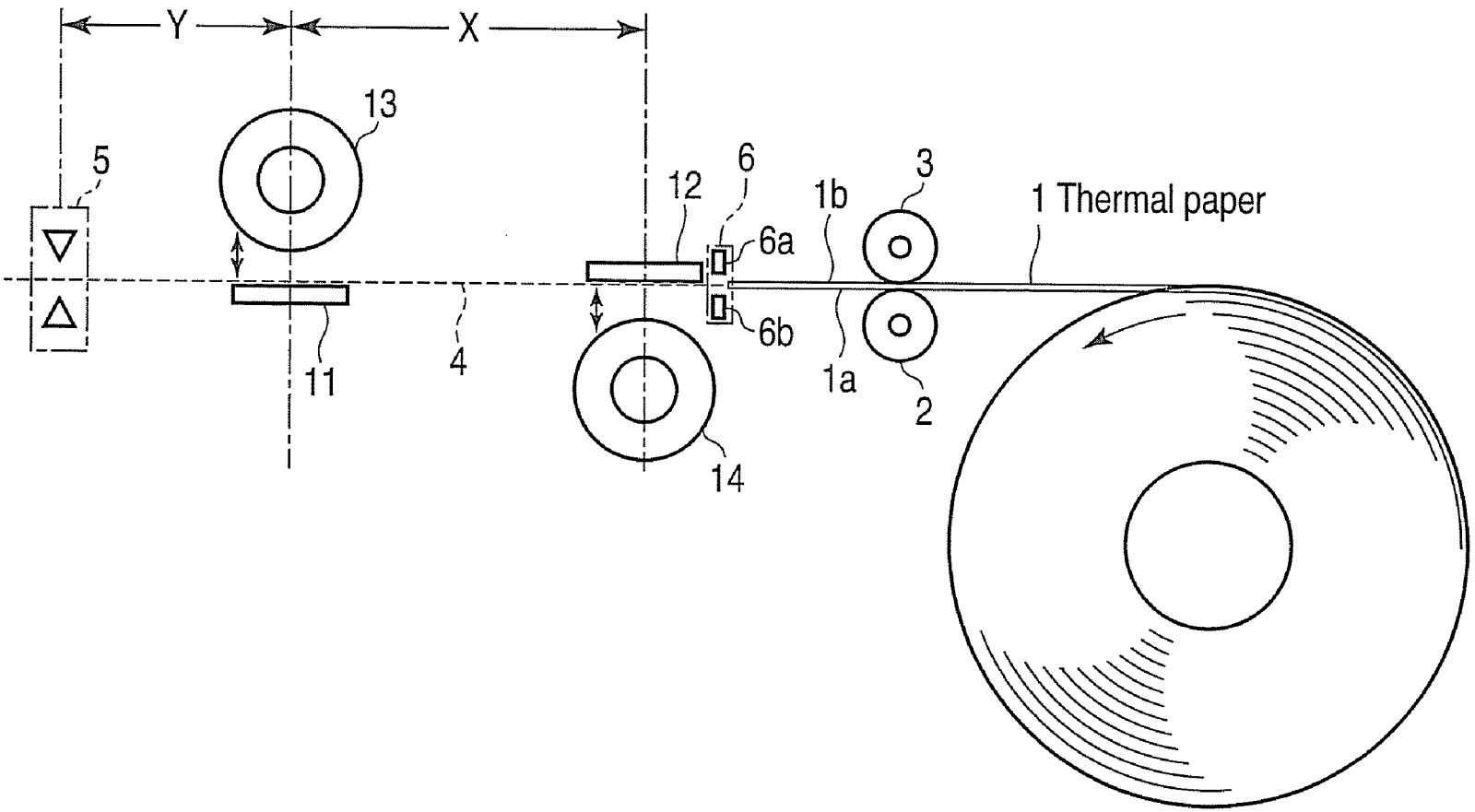
FIG. 1 is a diagram showing a configuration of an essential part of an embodiment of the invention.

In FIG. 1, a reference numeral 1 denotes thermal paper. The thermal paper 1 has a thermosensitive layer on one side (a front side) 1*a* and the other side (a back side) 1*b*. The rear end side of the thermal paper is wound like a roll with the front side 1*a* faced inside, and the front end side is fed to a paper-feeding path 4 by paper-feeding rollers 2 and 3, and conveyed on the paper-feeding path 4. The thermosensitive layers are made of material, which turns black or red, for example, when it is heated to a temperature higher than a predetermined value.

Along the feeding direction of the thermal paper 1, there are provided a first thermal head 11 which contacts the front side 1*a* of the thermal paper 1, and a second thermal head 12 which contacts the back side 1*b* of the thermal paper. The first and second thermal heads 11 and 12 are shaped to extend in the direction perpendicular to the thermal paper 1 feeding direction, or in the width direction of the thermal paper 1, and provided at positions apart each other along the thermal paper 1 feeding direction. In other words, the first thermal head 11 is positioned in the downstream of the second thermal head 12 in the thermal paper 1 feeding direction.

A first platen roller 13 is provided at a position opposite to the first thermal head 11 through the paper-feeding path 4, and a second platen roller 14 is provided at a position opposing the second thermal head 12 through the paper-feeding path 4. The first platen roller 13 can move to or away from the first thermal head 11 as indicated by an arrow, presses the thermal paper 1 to the first thermal head 11 by moving to the first thermal head 11, and efficiently contacts the front side 1*a* of the thermal paper sheet 1 with the first thermal head 11. The second platen roller 14 can move to or away from the second thermal head 12 as indicated by an arrow, presses the thermal paper 1 to the second thermal head 12 by moving to the second thermal head 12, and efficiently contacts the back side 1*b* of the thermal paper 1 with the second thermal head 12.

A cutter 5 for cutting the thermal paper 1 is provided at a position in the downstream of the first thermal head 11 and first platen roller 13 in the paper-feeding direction.

The distance between from the first thermal head 11 and the second thermal head 12 is X, and the distance between the first thermal head 11 and the cutter 5 is Y.

A paper sheet sensor 6 is provided at a position before the second thermal head 12 in the paper-feeding direction. The paper sheet sensor 6 is a photocoupler comprising a light-emitting element 6*a* and a light-receiving element 6*b*, opposing each other through the paper-feeding path 4. The paper sheet sensor detects whether the front end of the thermal paper 1 reaches the position before the second thermal head 12, by changes in the light received by the light-receiving element 6*b*, which receives the light emitted from the light-emitting element 6*a*.

Figure 2:
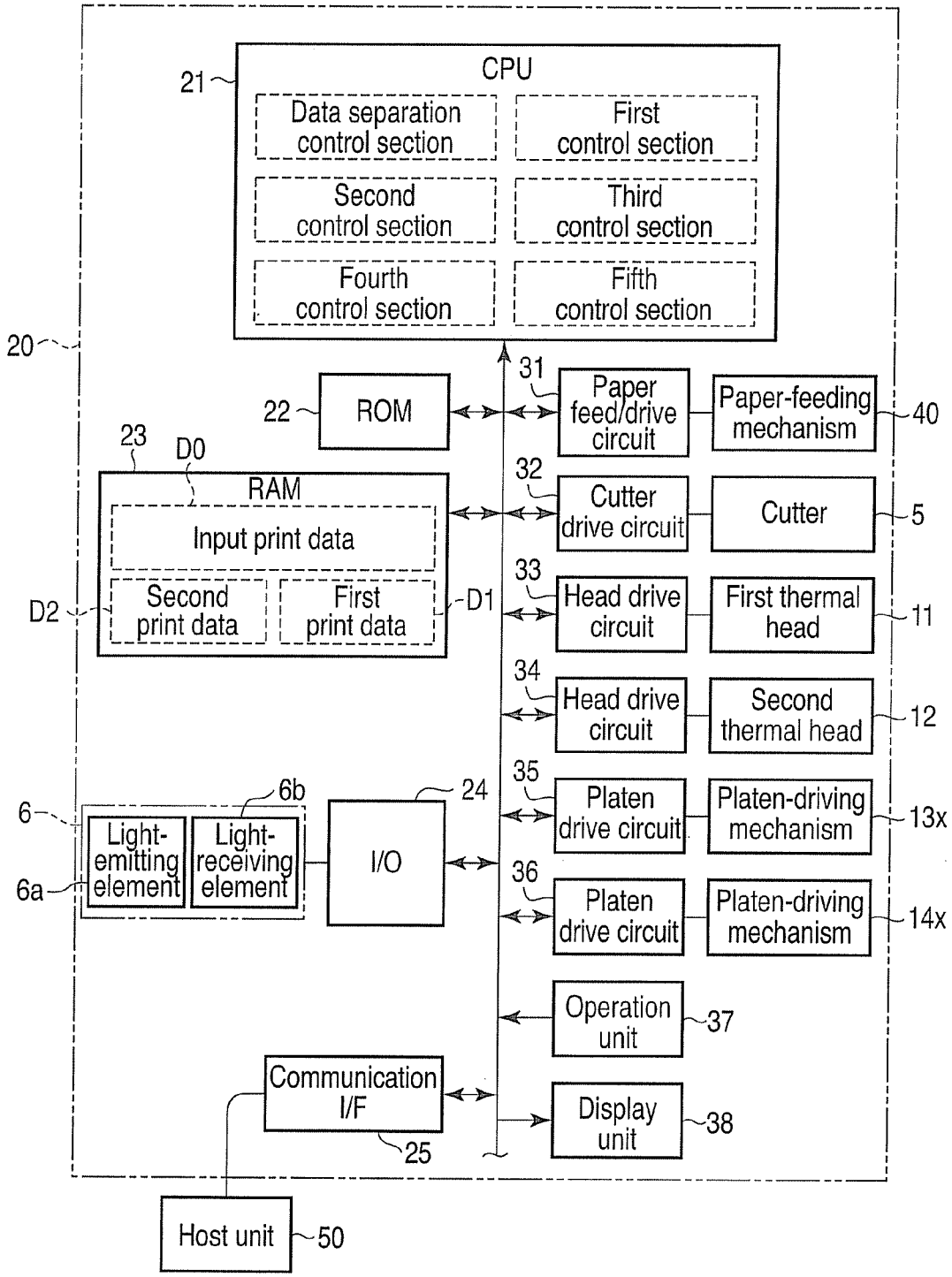
FIG. 2 is a block diagram of a control circuit of an embodiment of the invention.

FIG. 2 shows a control circuit of a thermal printer 20, which includes the configuration of FIG. 1. A main control unit CPU 21 is connected to a ROM 22 for storing a control program, a RAM for storing data, an input/output unit (I/O) 24, a communication interface 25, a paper feed/drive circuit 31, a cutter drive circuit 32, head drive circuits 34 and 34, platen drive circuits 35 and 36, an operation unit 37 for setting operating conditions, and a display unit 38.

The input/output unit 24 is connected to the paper sensor 6. The communication interface 25 is connected to an external host unit 50. The paper feed/drive circuit 31 drives a paper-feeding mechanism, which includes the paper feeding-rollers 2/3 and paper-feeding path 4. The cutter drive circuit 32 drives the cutter 5. The head drive circuits 33 and 34 drive the first and second thermal heads 11 and 12, respectively. The platen drive circuits 35 and 36 drive the platen-driving mechanisms 13*x* and 14*x* for supplying power needed to move the platen rollers 13 and 14.

The CPU 21 has the following means (1) to (6) as primary functions.

(1) A data separation control section, which separates print data D0 supplied from an external host unit 50 into a first print data D1 for the front side 1*a* of the thermal paper 1, and a second print data D2 for the back side 1*b* of the thermal paper 1. The print data D0, first print data D1, and second print data D2 are stored in the RAM 23.

(2) A first control section, which starts movement of the first platen roller 13 at a predetermined timing considering the distance from the paper sensor 6 to the first and second thermal heads 11 and 12, and the thermal paper 1 feeding speed, at the time of printing with the first thermal head 11, so that the movement of the first platen roller 13 is completed at the time when the thermal paper 1 reaches the first thermal head 11.

(3) A second control section, which starts movement of the second platen roller 14 at a predetermined timing based on a time count t, considering the distance from the paper sensor 6 to the first and second thermal heads 11 and 12, and the thermal paper 1 feeding speed at the time of printing with the second thermal head 12, so that the movement of the second platen roller 14 is completed at the time when the thermal paper 1 reaches the second thermal head 12.

(4) A third control section, which cuts the thermal paper 1 by operating the cutter 5, after the rear end of the thermal paper 1 printed with the thermal heads 11 and 12 passes through the cutter 5.

(5) A fourth control section, which moves the platen rollers 13 and 14 away from the thermal heads 11 and 12, after the thermal paper 1 is cut by the third control section.

(6) A fifth control section, which returns the front end of the thermal paper 1 to the position before the second thermal head 12, based on the detection result of the paper sensor 6, after the fourth control section moves the platen rollers 13 and 14 away from the thermal heads 11 and 12.

Figure 3:
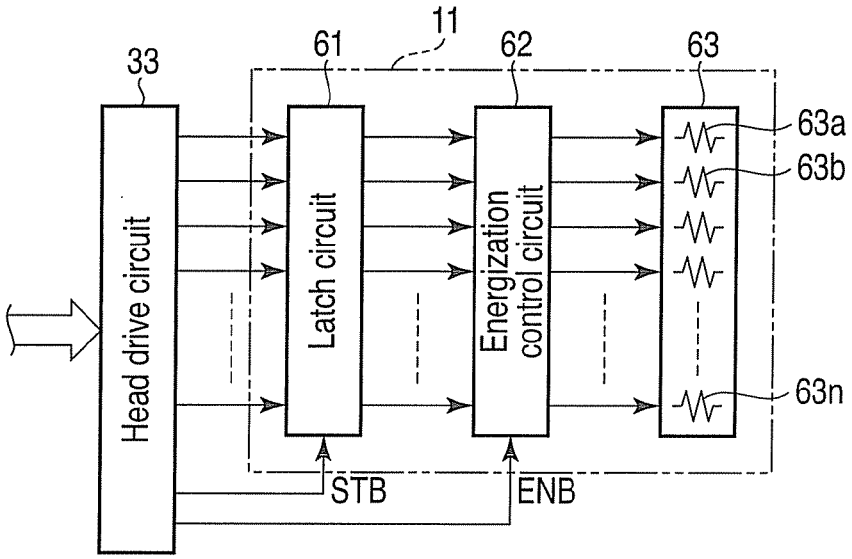
FIG. 3 is a block diagram showing a concrete configuration of a thermal head in an embodiment of the invention.

The first thermal head 11 comprises a latch circuit 61, an energization control circuit 62, and an edge head 63, as shown in FIG. 3. The edge head 63 has a number of linearly arranged heat transfer heating elements 63*a*, 63*b*, . . . 63*n*. The latch circuit 61 latches the first print data D1 supplied from the head drive circuit 33 for every line according to a strobe signal STB supplied from the head drive circuit 33. The energization control circuit 62 controls energization of the heating elements 63*a*, 63*b*, . . . 63*n* of the edge head 63, according to the data in the latch circuit 61, at the timing when the enable signal ENB supplied from the head drive circuit 33 is activated. The second thermal head 12 has the same configuration as the first thermal head 11.

Figure 4:
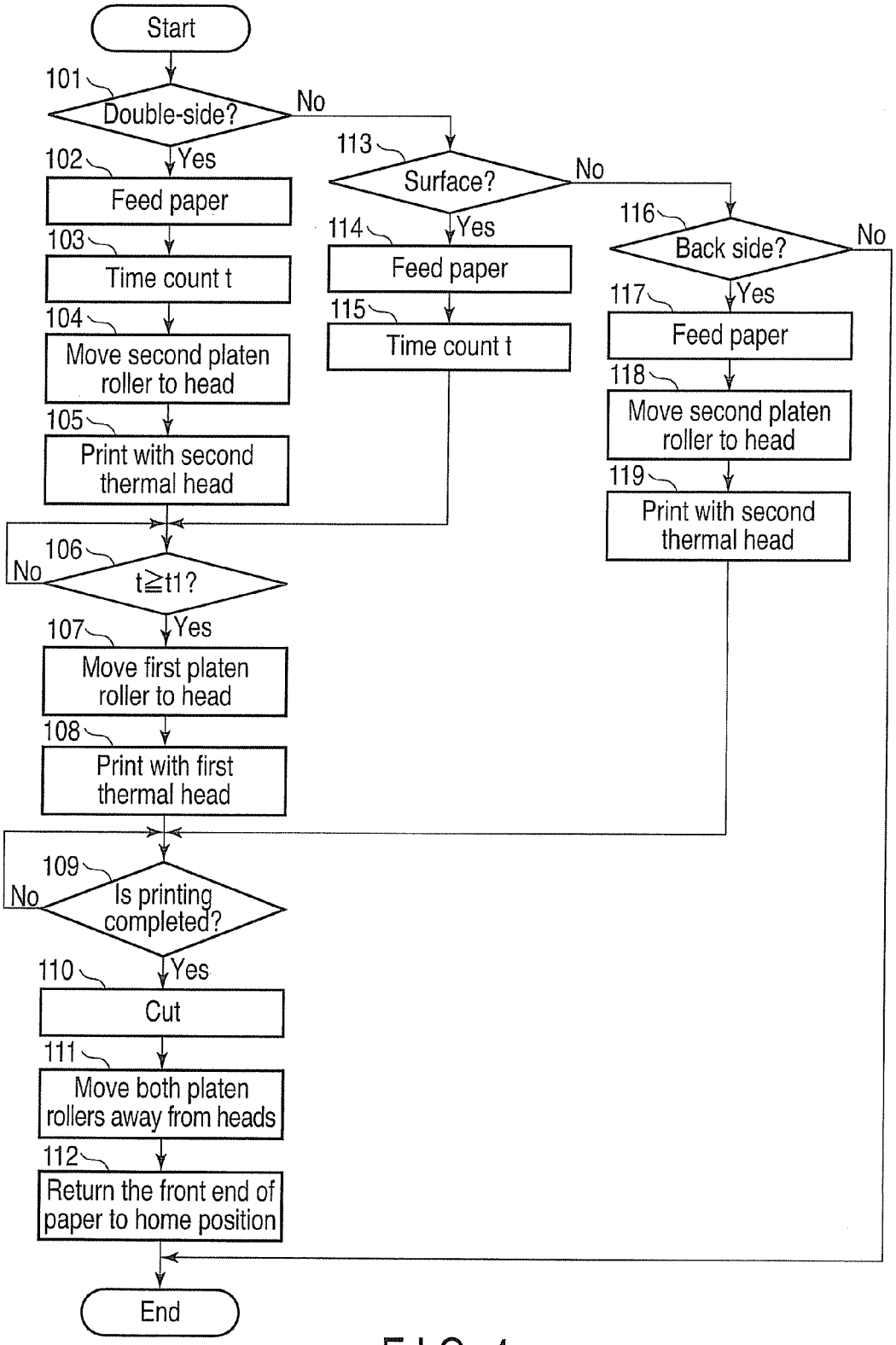
FIG. 4 is a flowchart for explaining operations of an embodiment of the invention.

Next, the functions of the embodiment will be explained with reference to the flowchart of FIG. 4.

In non-printing, the platen rollers 13 and 14 are moved away from the first and second thermal heads 11 and 12, and the front end of the thermal paper 1 is set ready at a position (a home position) corresponding to the paper sensor 6 located before the second thermal head 12, as shown in FIG. 1.

Figure 7:
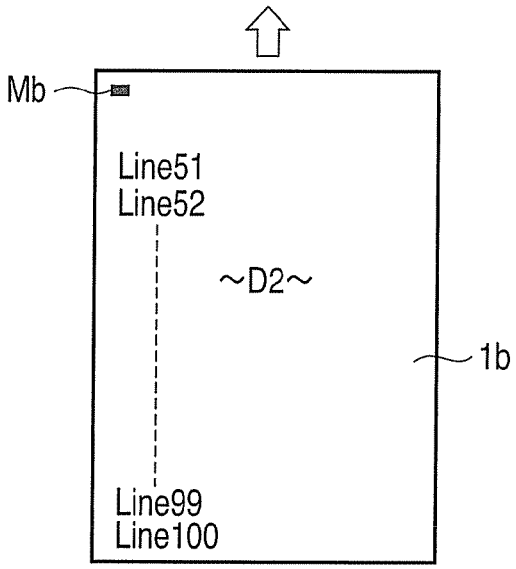
FIG. 7 is a diagram showing an example of printing print data D2 on the back side of thermal paper by double-side printing, in an embodiment of the invention.
Figure 5:
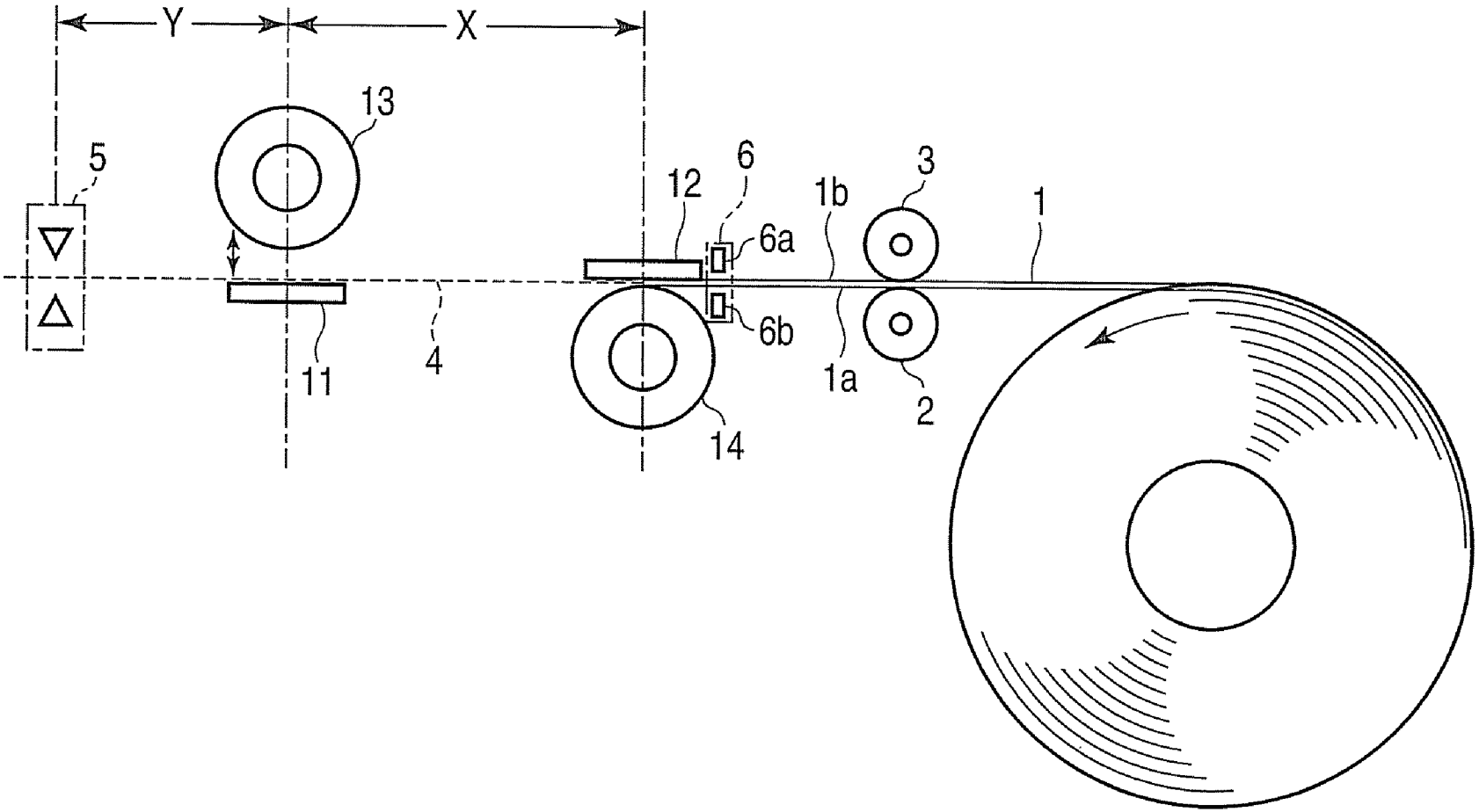
FIG. 5 is a diagram showing a state, in which the front end of thermal paper reaches a second thermal head in an embodiment of the invention.
Figure 6:
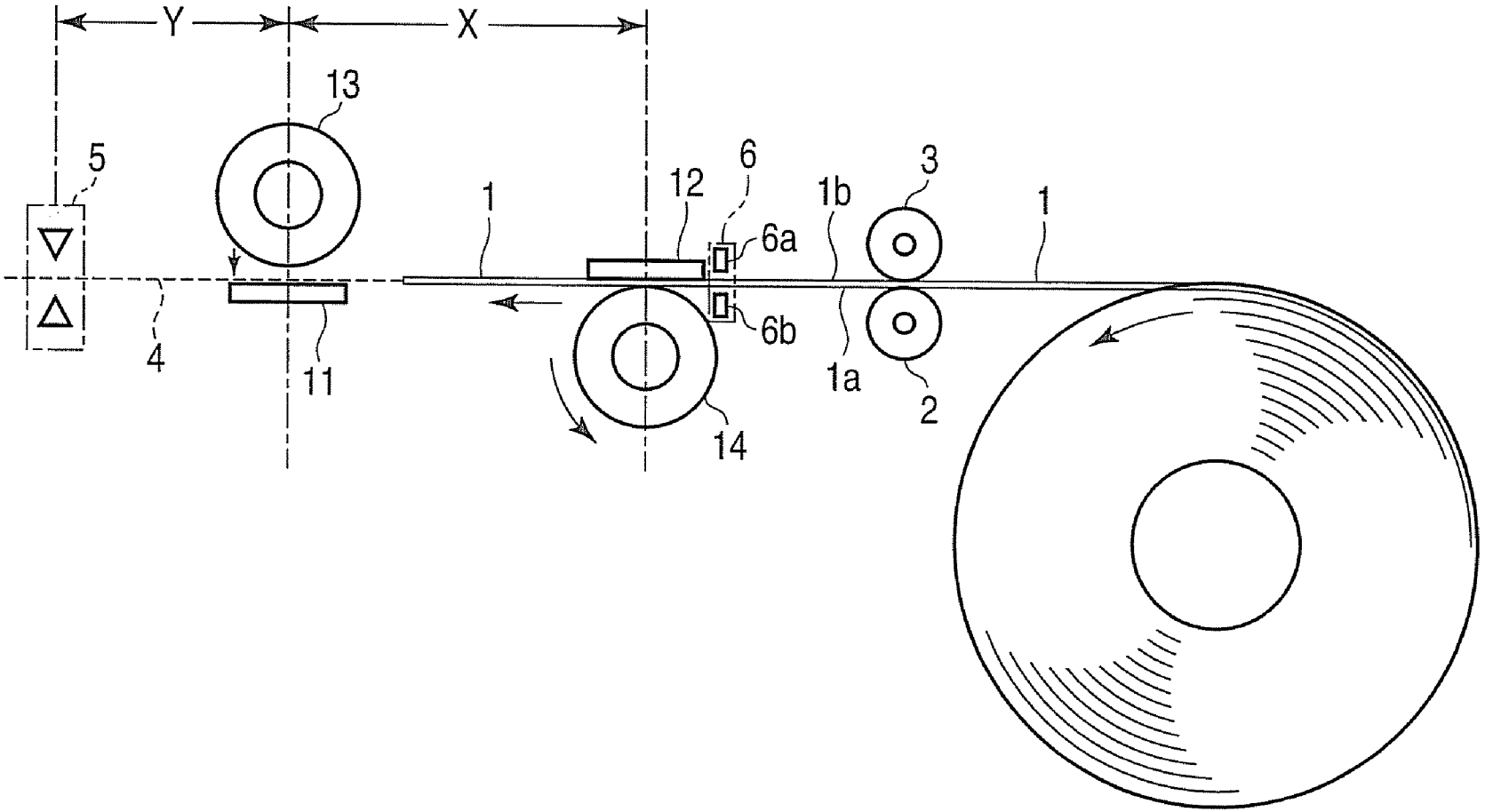
FIG. 6 is a diagram showing a state, in which the front end of thermal paper passes through a second thermal head, and reaches a position before a first thermal head, in an embodiment of the invention.

In double-side printing with the thermal heads 11 and 12 (YES in step 101), when the thermal paper 1 is fed (step 102), time count t is started (step 103). Movement of the second platen roller 14 is started (step 104) at a predetermined timing considering the distance from the paper sensor 6 to the second thermal head 12 and paper-feeding speed, so that the movement of the second platen roller 14 is completed at the time when the thermal paper 1 reaches the second thermal head 12. When the front end of the thermal paper 1 reaches the second thermal head 12, as shown in FIG. 5, the second platen roller 14 contacts the front end of the thermal paper 1, and the thermal paper 1 is held between the second thermal head 12 and second platen roller 14. The back side 1*b* of the thermal paper 1 is pressed to the second thermal head 12 by the second platen roller 14, as shown in FIG. 6, the thermal paper 1 is continuously fed in this state, and the second print data D2 is printed on the back side 1*b* of the thermal paper 1 by the second thermal head 12, as shown in FIG. 7 (step 105).

Figure 8:
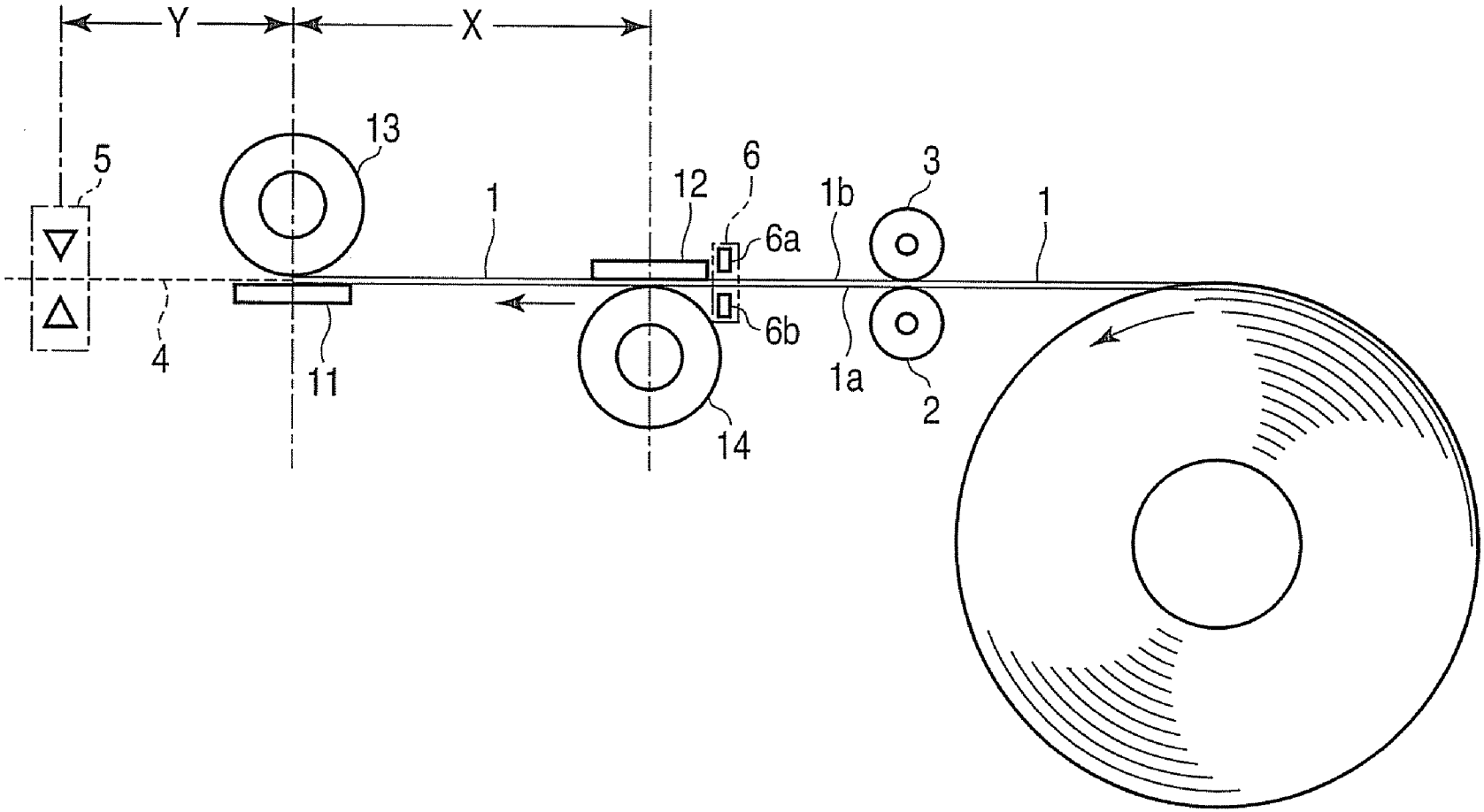
FIG. 8 is a diagram showing a state, in which the front end of thermal paper reaches a first thermal head in an embodiment of the invention.
Figure 9:
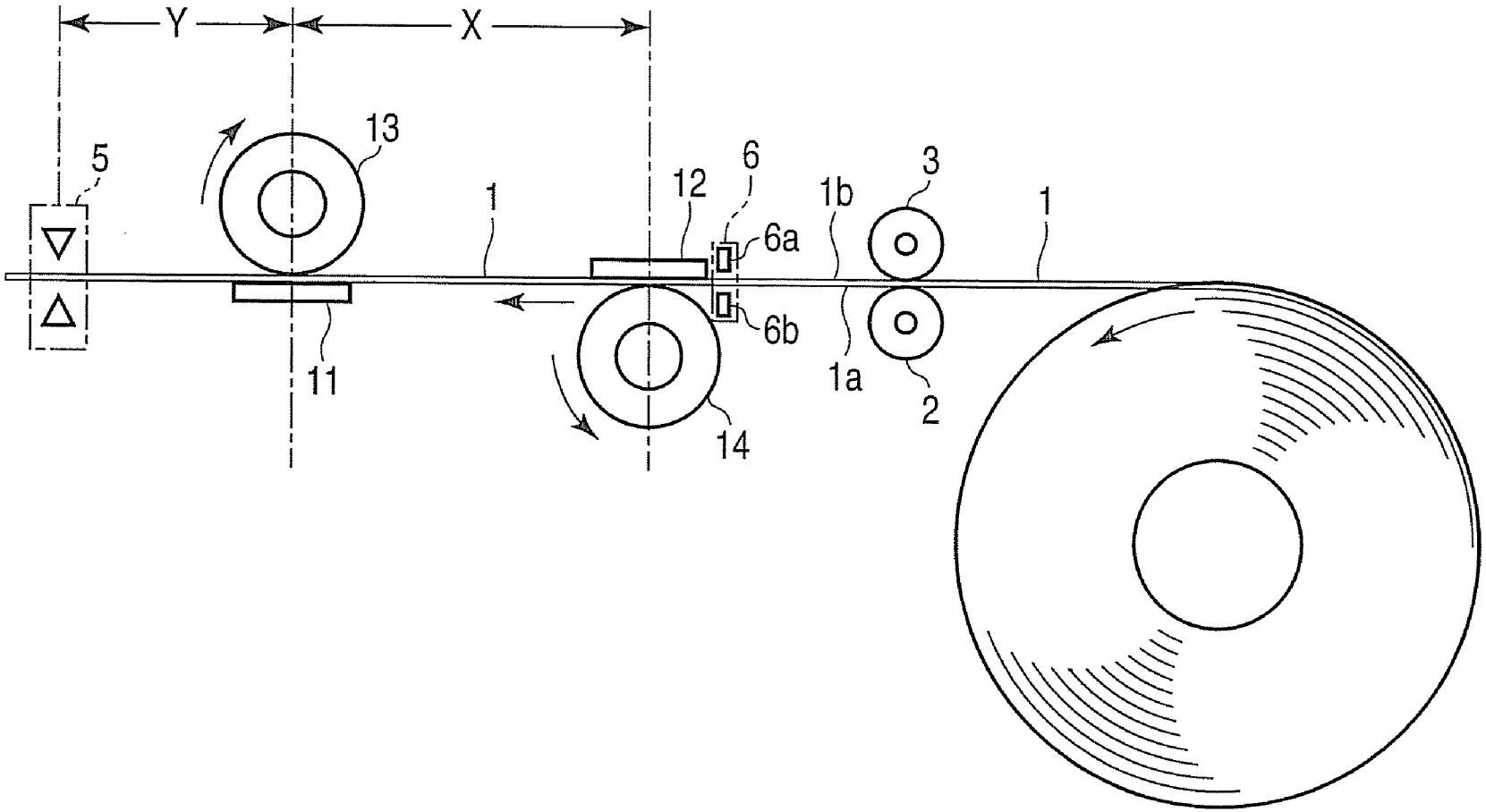
FIG. 9 is a diagram showing a state, in which the front end of thermal paper passes through a first thermal head in an embodiment of the invention.
Figure 10:
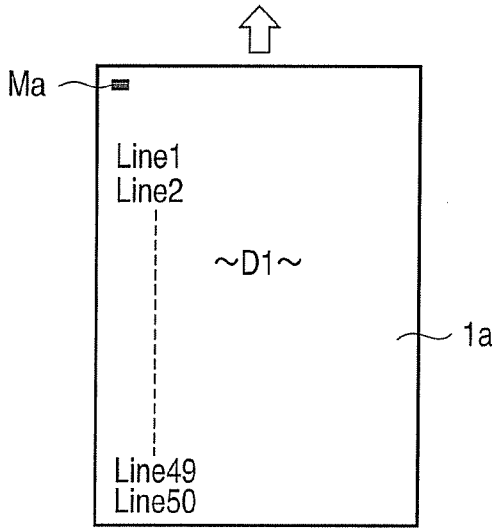
FIG. 10 is a diagram showing an example of printing of print data D1 on the front side of thermal paper by double-side printing, in an embodiment of the invention.

As the second thermal head 11 starts printing, the time count t is compared with a predetermined set time t1 (step 106). When the time count t reaches the predetermined set time t1 (YES in step 106), the front end of the thermal paper 1 passes through the second thermal head 12, reaches the position before the first thermal head 11, and movement of the first platen roller 13 is started at this timing (step 107). When the front end of the thermal paper 1 reaches the first thermal head 11, as shown in FIG. 8, the first platen roller 13 contacts the front end of the thermal paper 1, and the thermal paper 1 is held between the first thermal head 11 and second platen roller 13. The front side 1*a* of the thermal paper 1 is pressed to the first thermal head 11 by the first platen roller 13, as shown in FIG. 9, the thermal paper 1 is continuously fed in this state, and the first print data D1 is printed on the front side 1*a* of the thermal paper 1 with the first thermal head 11, as shown in FIG. 10 (step 108).

When the printing with the first and second thermal heads 11 and 12 is completed (YES in step 109), the rear end of the thermal paper 1 at the print position passes through the cutter 5, and the thermal paper 1 is cut by the cutter 5 (step 110).

After the thermal paper is cut, the platen rollers 13 and 14 are moved away from the thermal heads 11 and 12 (step 111), and the front end of the thermal paper 1 is returned to the position before the second thermal head 12, based on the detection result of the paper sensor 6.

In one-side printing with the first thermal head 11 (NO in step 101, YES in step 113), when the thermal paper 1 is fed (step 114), time count t is started (step 115). The fed thermal paper 1 passes through between the second thermal head 12 and second platen roller 14, and is fed to the first thermal head 11. When the time count 5 reaches a predetermined set time t1 (YES in step 106), movement of the first platen roller 13 is started (step 107). When the front end of the thermal paper 1 reaches the first thermal head 11, as shown in FIG. 8, the first platen roller 13 contacts the front end of the thermal paper 1, and the thermal paper is held between the first thermal head 11 and second platen roller 13. The front side 1*a* of the thermal paper 1 is pressed to the first thermal head 11 by the first platen roller 13, as shown in FIG. 9, and the thermal paper 1 is continuously fed in this state, and the first print data D1 is printed on the front side 1*a* of the thermal paper 1 with the first thermal head 11, as shown in FIG. 10 (step 108).

When the printing with the first thermal head 11 is completed (YES in step 109), the rear end of the thermal paper 1 at the print position passes through the cutter 5, and the cutter 5 cuts the thermal paper 1 (step 110).

After the paper is cut, the platen rollers 13 and 14 are moved away from the thermal heads 11 and 12 (step 111), and the front end of the thermal paper 1 is returned to the position before the second thermal head 12, based on the detection result of the paper sensor 6 (step 112).

In front side printing with the second thermal head 12 (NO in step 101, No in step 113, Yes in step 116), movement of the second platen roller 14 is started (step 118) at a predetermined timing considering the distance from the paper sensor 6 to the second thermal head 12 and paper feeding speed, so that the movement of the second platen roller 14 is completed at the time when the thermal paper 1 is fed (step 117), and reaches the second thermal head 12. When the front end of the thermal paper 1 reaches the second thermal head 12, as shown in FIG. 5, the second platen roller 14 contacts the front end of the thermal paper 1, and the thermal paper 1 is held between the second thermal head 12 and second platen roller 14. The back side 1*b* of the thermal paper 1 is pressed to the second thermal head 12 by the second platen roller 14, the thermal paper 1 is continuously fed in this state, and the second print data D2 is printed on the back side 1*b* of the thermal paper 1 with the second thermal head 12, as shown in FIG. 7 (step 119).

When the printing with the second thermal head 12 is completed (YES in step 109), the rear end of the thermal paper 1 at the print position passes through the cutter 5, and the cutter 5 cuts the thermal paper 1 (step 110).

After the paper is cut, the platen rollers 13 and 14 are moved away from the thermal heads 11 and 12 (step 111), and the front end of the thermal paper 1 is returned to the position before the second thermal head 12, based on the detection result of the paper sensor 6 (step 112).

Figure 11:
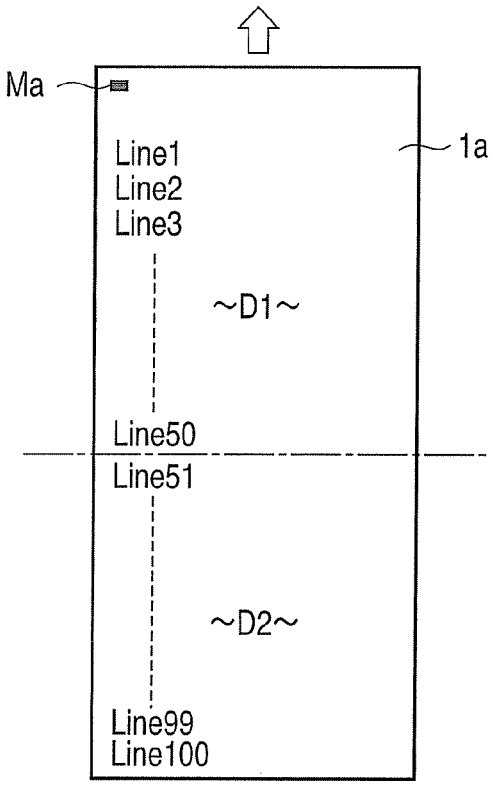
FIG. 11 is a diagram showing an example of printing print data D1 and D2 on the front side of thermal paper by one-side printing with a first thermal head, in an embodiment of the invention.
Figure 12:
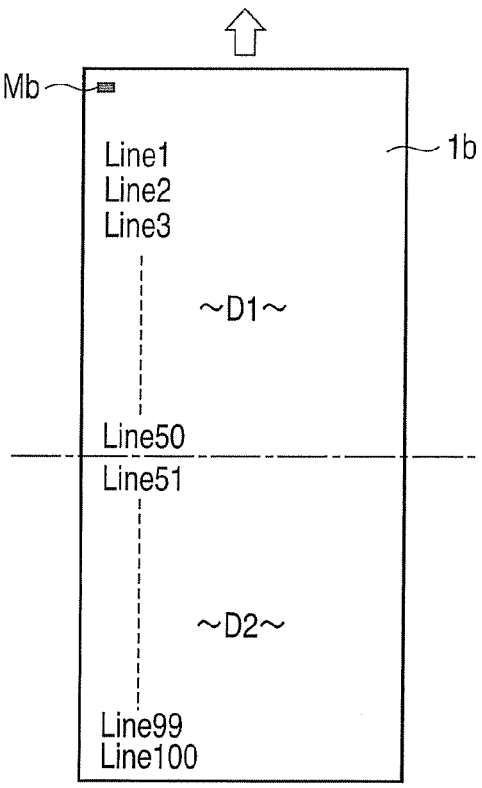
FIG. 12 is a diagram showing an example of printing print data D1 and D2 on the back side of thermal paper by one-side printing with a second thermal head, in an embodiment of the invention.

FIG. 11 shows an example, in which the first and second print data D1 and D2 are printed on the front side 1*a* of the thermal paper 1 with the first thermal head 11. FIG. 12 shows an example, in which the first and second print data D1 and D2 are printed on the back side 1*b* of the thermal paper 1 with the second thermal head 12.

As in a conventional printer, if paper feeding is stopped when the front end of thermal paper reaches a thermal head, a platen roller is moved to a thermal head, and paper feeding is restarted when the thermal paper is held between the thermal head and platen roller, and printing is started, a printing speed is delayed by the time to stop paper feeding halfway, and a stripe-like line so called a white line appears on thermal paper in the direction perpendicular to the paper feeding direction, as described before.

In contrast, according to this embodiment, movement of the first and second platen rollers 13 and 14 is started at a predetermined timing considering the distance from the paper sensor 6 to the first and second thermal heads 11 and 12, and paper feeding speed, so that the movement of the first and second platen rollers 13 and 14 is completed at the time when the thermal paper 1 reaches the first and second thermal heads 11 and 12. Therefore, when the front end of the thermal paper 1 reaches the first and second thermal heads 11 and 12, the second platen roller 14 contacts the front end of the thermal paper 1, and printing is executed with the first and second thermal heads 11 and 12 without stopping paper feeding.

As feeding of thermal paper 1 is not stopped halfway, a printing speed is increased, and a stripe-like white line perpendicular to the paper feeding direction does not appear on the thermal paper 1. Prevention of a white line improves the print quality.

In the above embodiment, the timing of starting movement of the first and second platen rollers 13 and 14 is determined by considering the distance from the paper sensor 6 positioned before the second thermal head 12 to the first and second thermal heads 11 and 12, and paper feeding speed. Decision of the timing is not limited to this. For example, one paper sensor may be added between the first and second thermal heads 11 and 12 in the paper-feeding path 4, the timing of starting movement of the second platen roller 14 may be determined by considering the distance from the paper sensor 6 to second thermal head 12, and paper feeding speed. The timing of starting movement of the first platen roller 13 may be determined by considering the distance from the added paper sensor to the first thermal head 11, and paper feeding speed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

thermal paper, which has a thermosensitive layer on both sides, and is fed in a predetermined direction;

a first thermal head which prints one side of the thermal paper;

a second thermal head which prints the other side of the thermal paper;

a first platen, which is provided at a position opposite to the first thermal head through a thermal paper feeding path, movable to or away from the first thermal head, and presses the thermal paper to the first thermal head by moving to the first thermal head;

a second platen, which is provided at a position opposite to the second thermal head through the thermal paper feeding path, movable to or away from the second thermal head, and presses the thermal paper to the second thermal head by moving to the second thermal head;

a first control section, which starts movement of the first platen at the time of printing with the first thermal head, so that the movement of the first platen is completed at the time when the thermal paper reaches the first thermal head; and a second control section, which starts movement of the second platen at the time of printing with the second thermal head, so that the movement of the second platen is completed at the time when the thermal paper reaches the second thermal head.

2. The printer according to claim 1, wherein the first thermal head and second thermal head are provided at positions apart from each other along the thermal paper feeding path.

3. The printer according to claim 2, wherein the first thermal head is positioned in the downstream of the second thermal head in the thermal paper feeding path.

4. The printer according to claim 3, further comprising:

a cutter provided in the downstream of the first thermal head in the thermal paper feeding path;

a third control section, which operates the cutter to cut the thermal paper printed with each thermal heat, after the rear end of the thermal paper at a print position passes through the cutter;

a fourth control section, which moves said each platen away from said each thermal head, after the third control section cuts the thermal paper; and a fifth control section, which returns the front end of the thermal paper to a position before the second thermal head, after the fourth control section moves said each platen away from said each thermal head.

5. The printer according to claim 4, further comprising a paper sensor which detects whether the front end of the thermal paper reaches the position before the second thermal head.

6. The printer according to claim 5, wherein the fifth control section returns the front end of the thermal paper to the position before the second thermal head, based on the detection result of the paper sensor, after the fourth control section moves said each platen away from said each thermal head.

7. A thermal printer comprising:

thermal paper, which has a thermosensitive layer on both sides, and is fed in a predetermined direction;

a first thermal head which prints one side of the thermal paper;

a second thermal head which prints the other side of the thermal paper;

a first platen, which is provided at a position opposite to the first thermal head through a thermal paper feeding path, movable to or away from the first thermal head, and presses the thermal paper to the first thermal head by moving to the first thermal head;

a second platen, which is provided at a position opposite to the second thermal head through the thermal paper feeding path, movable to or away from the second thermal head, and presses the thermal paper to the second thermal head by moving to the second thermal head;

a first control means, for starting movement of the first platen at the time of printing with the first thermal head, so that the movement of the first platen is completed at the time when the thermal paper reaches the first thermal head; and a second control means, for starting movement of the second platen at the time of printing with the second thermal head, so that the movement of the second platen is completed at the time when the thermal paper reaches the second thermal head.

8. The printer according to claim 7, wherein the first thermal head and second thermal head are provided at positions apart from each other along the thermal paper feeding path.

9. The printer according to claim 8, wherein the first thermal head is positioned in the downstream of the second thermal head in the thermal paper feeding path.

10. The printer according to claim 9, further comprising:

a cutter provided in the downstream of the first thermal head in the thermal paper feeding path;

a third control means, for operating the cutter to cut the thermal paper printed with each thermal heat, after the rear end of the thermal paper at a print position passes through the cutter;

a fourth control means, for moving said each platen away from said each thermal head, after the third control means cutting the thermal paper; and a fifth control means, for returning the front end of the thermal paper to a position before the second thermal head, after the fourth control means moving said each platen away from said each thermal head.

11. The printer according to claim 10, further comprising a paper sensing means for detecting whether the front end of the thermal paper reaches the position before the second thermal head.

12. The printer according to claim 11, wherein the fifth control means returning the front end of the thermal paper to the position before the second thermal head, based on the detection result of the paper sensing means, after the fourth control means moving said each platen away from said each thermal head.

13. A method of controlling a thermal printer having:

thermal paper, which has a thermosensitive layer on both sides, and is fed in a predetermined direction;

a first thermal head which prints one side of the thermal paper, and a second thermal head which prints the other side of the thermal paper, which are provided at positions apart from each other along a thermal paper feeding direction;

a first platen, which is provided at a position opposite to the first thermal head through the thermal paper feeding path, movable to or away from the first thermal head, and presses the thermal paper to the first thermal head by moving to the first thermal head; and a second platen, which is provided at a position opposite to the second thermal head through the thermal paper feeding path, movable to or away from the second thermal head, and presses the thermal paper to the second thermal head by moving to the second thermal head, the method comprising:

starting movement of the first platen at the time of printing with the first thermal head, so that the movement of the first platen is completed at the time when the thermal paper reaches the first thermal head; and starting movement of the second platen at the time of printing with the second thermal head, so that the movement of the second platen is completed at the time when the thermal paper reaches the second thermal head.

* * * * *